US006901641B2

(12) United States Patent
Bergeron et al.

(10) Patent No.: US 6,901,641 B2
(45) Date of Patent: Jun. 7, 2005

(54) METHOD FOR MANUFACTURING A VALANCE HAVING A RIDGE WITH AN ACCENT COLOR

(75) Inventors: Bruno Bergeron, Davie, FL (US); Michael Julius Biro, Boca Raton, FL (US)

(73) Assignee: Isoteck Corporation, Pompano Beach, FL (US)

( * ) Notice: Subject to any disclaimer, the term of this patent is extended or adjusted under 35 U.S.C. 154(b) by 78 days.

(21) Appl. No.: 10/157,678

(22) Filed: May 29, 2002

(65) Prior Publication Data

US 2003/0221793 A1 Dec. 4, 2003

(51) Int. Cl.[7] ..... B23P 19/04; B29C 47/06

(52) U.S. Cl. ..... 29/24.5; 29/428; 29/527.2; 29/530; 264/245; 264/173.16

(58) Field of Search ..... 29/24.5, 527.1, 29/527.2, 527.3, 530, 557, 558; 264/173.19, 245, 173.16, 174.1; 248/262, 223.41; 160/38, 32

(56) References Cited

U.S. PATENT DOCUMENTS 3,715,420 A 2/1973 Kiyono et al.
4,476,075 A 10/1984 Brinkmann et al.
4,753,766 A 6/1988 Pinsolle
4,828,002 A * 5/1989 Ashby ..... 160/38
5,171,499 A 12/1992 Cehelnik et al.
5,772,827 A 6/1998 Malm
6,094,796 A 8/2000 Biro
6,103,161 A 8/2000 Lopez
6,234,233 B1 5/2001 Biro

* cited by examiner

*Primary Examiner*—Marc Jimenez
(74) *Attorney, Agent, or Firm*—Ronald V. Davidge

(57) ABSTRACT

An extruded thermoplastic member includes a first material, having a first color, and an accent strip, having a second color, coextruded with the first material in the form of a ridge extending outward between corners in the surface of the thermoplastic member. A valance is constructed using such a thermoplastic member, with two such ridges extending along curved portions extending along the top and bottom of the thermoplastic member. The curved portions are formed as parts of closed structures, facilitating a miter sawing process used to cut the thermoplastic member into a central portion and a pair of end portions for the valance.

12 Claims, 3 Drawing Sheets

METHOD FOR MANUFACTURING A VALANCE HAVING A RIDGE WITH AN ACCENT COLOR

BACKGROUND OF THE INVENTION

1. Field of the Invention

This invention relates to coextruded thermoplastics, and, more particularly, to an extrusion having a ridge with an accent color produced by a coextrusion process and to a manufacturing process therefor and, yet more particularly, to the manufacture of such an extrusion for use in a valance.

2. Summary of the Background Art

A number of patents describe methods for manufacturing elongated plastic members and sheets having flat areas composed of two or more adjacent, differently colored materials by means of a coextrusion process. The location and nature of the juncture of the adjacent materials is a primary concern that is addressed by these patents. In the fabrication of a transparent thermoplastic sheet to be used as the inner layer of laminated safety glass for an automobile windshield, it is desirable to produce a smooth transition between the different colors of material within a relatively wide transition band. For example, U.S. Pat. No. 3,715,420 describes a coextrusion process for forming such a sheet to have a uniform overall thickness and to composed of a clear transparent material except for a band of colored transparent material, to extend along the top of the windshield, and a transition band in which the colored material extends as a wedge shape. Another method for obtaining a smooth transition within a transition band is described in U.S. Pat. No. 4,476,075, which describes such a sheet being formed using two parallel-operating extruders and melt pumps, with the transition band being produced by an injector means including a probe that, by way of a separate bypass conduit and an injection nozzle, injects colored composition in a wedge shape into the die processing the colorless material.

In other applications, a sharp transition between adjacent coextruded materials having different colors is needed, so that it is necessary to prevent a pre-solidification creep phenomenon that results in local uncontrollable migration between the materials having different colors, blurring the boundary between to adjacent colors. The prevention of this creep phenomenon is described, for example, in U.S. Pat. No. 4,753,766 as arising from minimizing the pressure within the material where the different colors of material are joined, with the stripes of different colors forming an intermediate layer and being kept separated from each other sufficiently downstream from a feed volume forming a buffer reservoir. In this way, the extrusion pressure is damped or relaxed. The physical properties of a base layer, of an intermediate layer formed by the colored stripes, and of a transparent upper layer are controlled so that these layers weld together simply by contact, without separation or migration of material from one colored stripe to another. Preferably, the stripes forming the intermediate layer are first connected together, are next connected to the upper transparent layer, and are then connected to the base layer. U.S. Pat. No. 6,103,161 describes a process in which this creep phenomenon is prevented by controlling parameters such as the pressure, speed, and flow volume within the melt streams forming each portion of the extruded material. The controls include means for strangling or throttling the flow of each melt stream into the extrusion process.

Other patents describe methods for incorporating strips of material to extend along or within extrusions. For example, U.S. Pat. No. 5,772,827 describes a method for forming a trim strip that includes intermediate, spaced-apart sections of a bright or color strip and portions extruded from clear or translucent melt streams. U.S. Pat. No. 5,171,499 describes a method of forming an elongated trim strip by first extruding a strip of thermoplastic material from a die and by pressing the extruded strip and a strip of foil or thin metal between cooperating forming rolls, immediately following the extrusion process, while the extruded strip is still in a plastic state.

Valances, or cornices, have been used for many years as decorative coverings for the mechanisms for attachment and movement of window coverings, such as curtains, drapes, shades, and blinds. U.S. Pat. No. 6,094,796 describes a process for extruding an elongated member, for cutting the elongated member into appropriate sections, and for assembling the sections with other elements to form a valance. The process of forming the elongated strip includes the coextrusion of a base material and of a material forming a decorative coating covering the portions of the base material which will be exposed when construction of the valance is completed.

What is needed is a method for producing an elongated member having a strip of an accent color extending along a ridge, with the elongated member being used, for example, in the fabrication of a valance. It is particularly desirable that the process for forming the ridge of material be the same as the process used to change the color of the material, and that the process should occur with a minimum level of transfer of visible colored material between the surface of the ridge and adjacent surfaces of the elongated member.

SUMMARY OF THE INVENTION

According to a first aspect of the invention, an elongated member is provided, including a first section composed of an extruded thermoplastic resin having a first color and a second section composed of a thermoplastic resin having a second color, contrasting with the first color. The second section is coextruded with the first section to extend along the first section. The elongated member has an external surface extending along the first and second sections. The external surface includes a corner extending between the first and second sections at each side of the second section. Preferably, the second section extends upward as a ridge between the corners at each side of the second section. For example, the elongated member is used to form the central portion of a valance.

According to another aspect of the invention, a valance is provided, including an extruded elongated central member and a pair of extruded end members attached to extend form each end of the elongated central member. Each of the end members has a transverse shape similar to a transverse shape of the central elongated member. Each end of the central elongated member is mitered to extend at a 45-degree angle relative to a length of the central elongated member. Each of the end member includes an end mitered to extend at a 45-degree angle relative to a length of the end member, attached to an end of the central elongated member. The central elongated member and each of the end members include an outwardly-curved upper portion, an outwardly-curved lower portion, an intermediate web extending between the upper portion and the lower portion, an upper web extending across the outwardly-curved upper portion to form a closed section, and a lower web extending across the outwardly-curved lower portion to form a closed section. The upper and lower webs facilitate forming the valance from a single elongated extruded member by sawing mitered edges by stiffening the single elongated extruded member to reduce deflection and vibration during the sawing operations. sawing mitered edges by stiffening the single elongated extruded member to reduce deflection and vibration during the sawing operations.

DETAILED DESCRIPTION OF THE INVENTION

Figure 1:
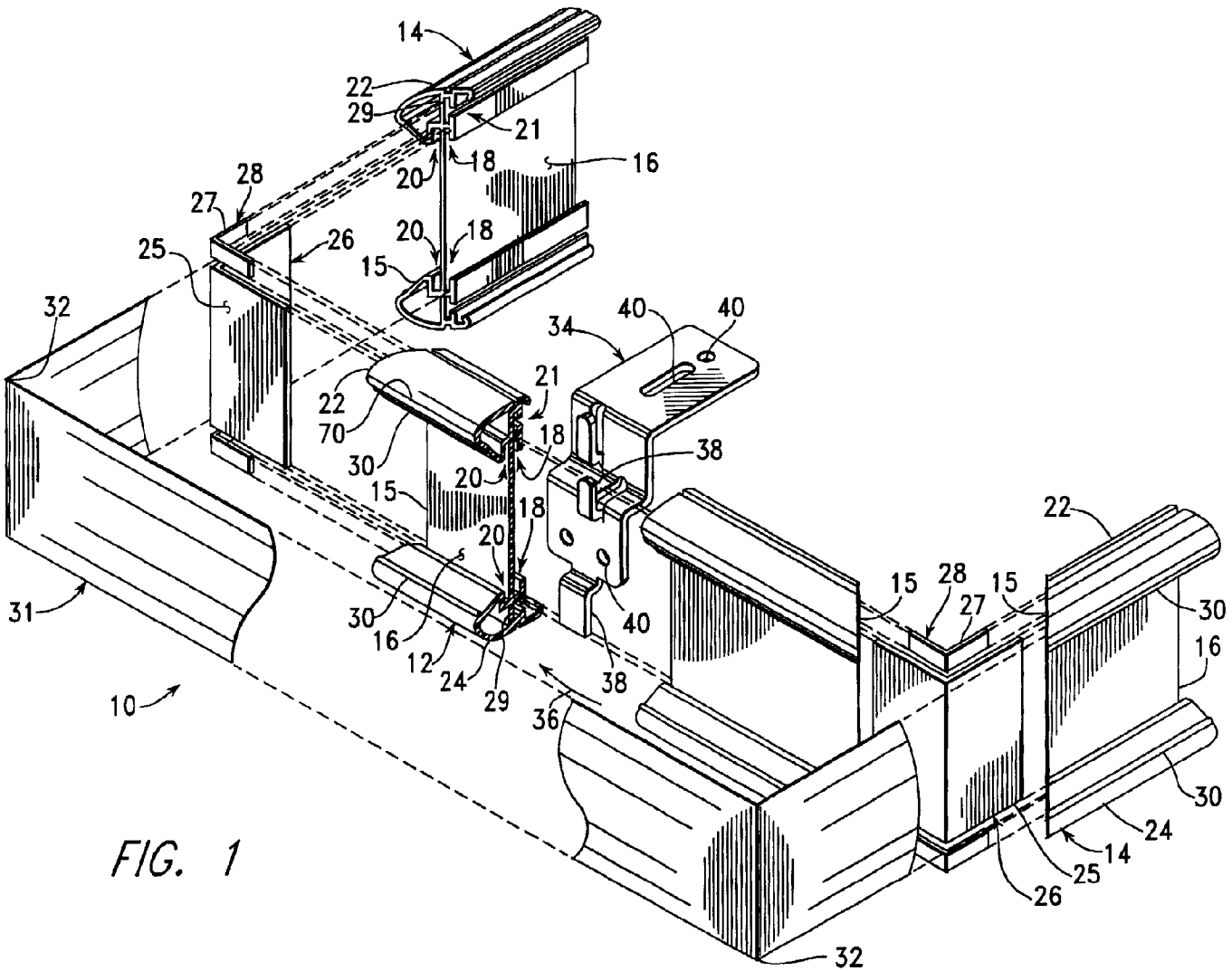
FIG. 1 is a fragmentary exploded view of a valance built in accordance with the invention.
Figure 2:
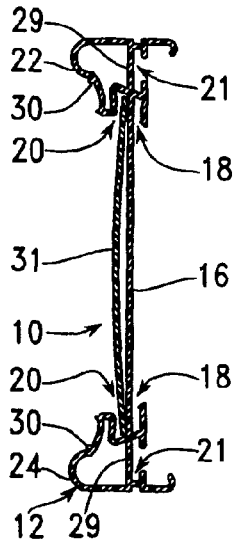
FIG. 2 is a transverse cross-sectional view of the valance of FIG. 1.

FIGS. 1 and 2 are view of a valance 10 built in accordance with the invention, with FIG. 1 being a fragmentary exploded view thereof, and with FIG. 2 being a transverse cross-sectional view thereof. Other aspects of the valance 10 described in U.S. Pat. No. 6,094,796, the disclosure of which is incorporated herein by reference. The main structure of the valance 10 includes a central portion 12 and a pair of end portions 14, all of which are cut from a single elongated extruded member, forming mitered end surfaces 15. Various features of these portions 12, 14, are formed in the single elongated extruded member during the extrusion process, including a flat web 16, rear slot surfaces 18, front slot surfaces 20, outer slot surfaces 21, an upper curved portion 22, and a lower curved portion 24. At each end surface 15 of the central portion 12, a leg 25 of an "L"-shaped bracket 26 is slid into place within the rear slot surfaces 18 of the central portion 12. Another leg 25 of each "L"-shaped bracket 26 is slid into place within the rear slot surfaces 18 of one of the end portions 14. In this way, the two end portions 14 are attached to the central portion 12. Alternately, the "L"-shaped brackets 26 are omitted, with legs 27 of small "L"-shaped brackets 28 instead being inserted within the outer slot surfaces 21 of the central portion 12 and the end portions 22. For example, the larger "L"-shaped brackets 26 are composed of a thermoplastic material, while the small "L"-shaped brackets 28 are composed of metal.

Since the central portion 12 and the end portions 14 are formed from a single elongated extruded member, their transverse shapes (i.e. the shapes shown in a transverse cross-sectional view, such as FIG. 2, are similar. In the example of FIGS. 1 and 2, the elongated extruded member used to form the central portion 12 and the end portions 14 is symmetrical, so this elongated member, having been cut to an appropriate length with end surfaces perpendicular to its length, is placed in the sawing apparatus described in U.S. Pat. No. 6,094,796 to saw the mitered surfaces 15 forming the end portions 14 from opposite ends of the elongated extruded member, with the remaining portion of the elongated extruded member forming the central portion 12. On the other hand, if the elongated extruded member is not symmetrical (for example, if the upper curved portion 22 and the lower curved portion 24 are of different sizes), the portion of the elongated extruded member remaining after the end portions 22 are removed has mitered surfaces slanted in the wrong direction, so it is necessary to apply the additional operations described in U.S. Pat. No. 6,094,796, removing scrap portions of this remaining portion of the elongated extruded member to form the central portion 12.

In accordance with a preferred version of the present invention, the curved portions 22, 24 each form part of a closed structure including a web 29, which therefore has a stiffness minimizing flexure and vibration during the sawing process used to form mitered edges 15.

Additionally in accordance with a preferred version of the present invention, the central portion 12 and the end portions 14 include a pair of accent strips 30, extending outwardly as ridges composed of a thermoplastic material having a color that is visibly different from the adjacent visible surfaces of the portions 12, 14. Preferably, the valance 10 also includes a trim strip 31, formed at corners 32 as also described in U.S. Pat. No. 6,094,796, and installed within the front slot surfaces 20 of the central portion 12 and the end portions 14. The accent strips 30 and the trim strop 31 may be of a common color contrasting with the color of remaining visible portions of the central portion 12 and end portions 14, or accent strips 30 may be of a different color, such as gold.

A number of attachment brackets 34 are also installed within the rear slot surfaces 18 of the central portion 12 to attach the valance 10 to a structural surface. Each attachment bracket 34 is installed by pivoting in the direction of arrow 36 to place the attachment tabs 38 of the bracket 34 within the rear slot surfaces 18. Apertures 40 within the attachment bracket 34 are then used to attach the bracket 34 to a headrail (not shown), for example, of a vertical blind assembly extending behind the valance 10 or, by means of additional mounting brackets (also not shown) to a wall extending behind the valance 10.

Figure 3:
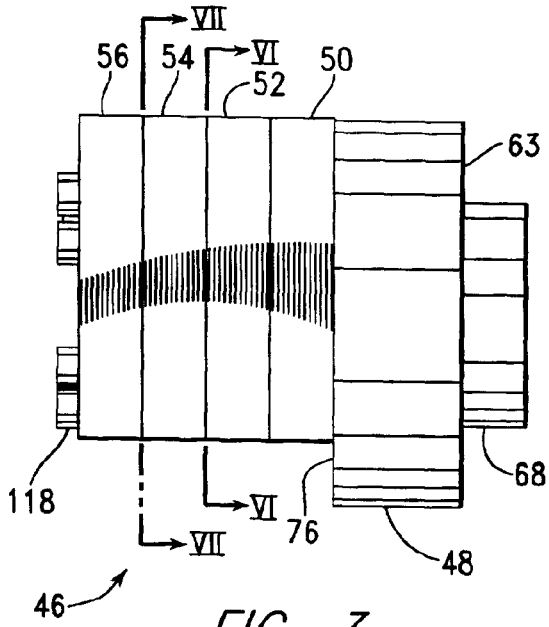
FIG. 3 is a right side elevation of an extrusion die set built in accordance with the invention to form an elongated member used in the manufacture of the valance of FIG. 1.
Figure 4:
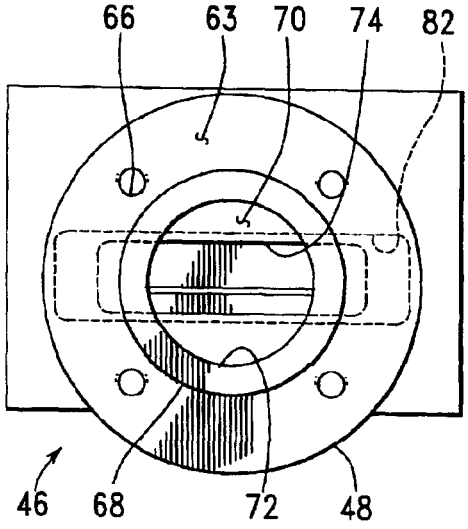
FIG. 4 is a rear elevation of the extrusion die set of FIG. 3.
Figure 5:
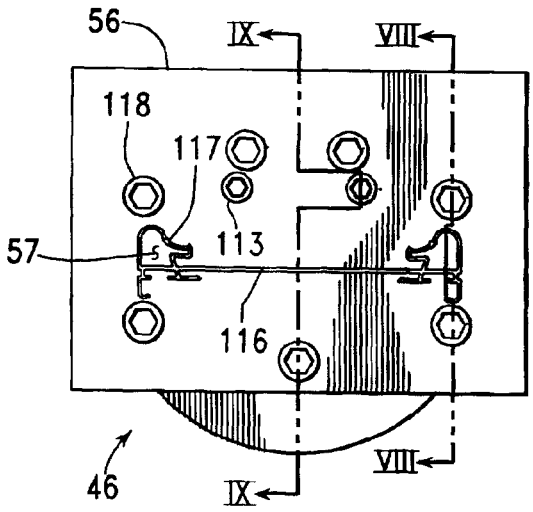
FIG. 5 is a front elevation of the extrusion die set of FIG. 3.
Figure 6:
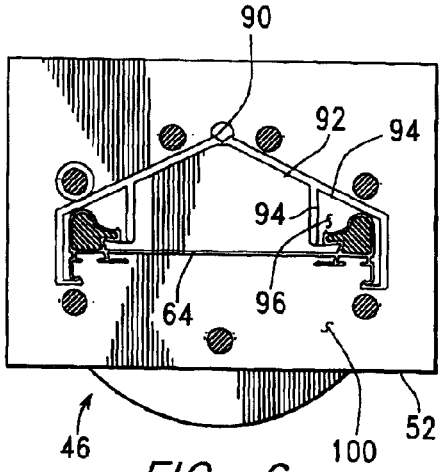
FIG. 6 is a transverse cross-sectional view of the extrusion die set of FIG. 3, taken as indicated by section lines VI—VI therein to show a die plate forming core and cap portions of the elongated member.
Figure 7:
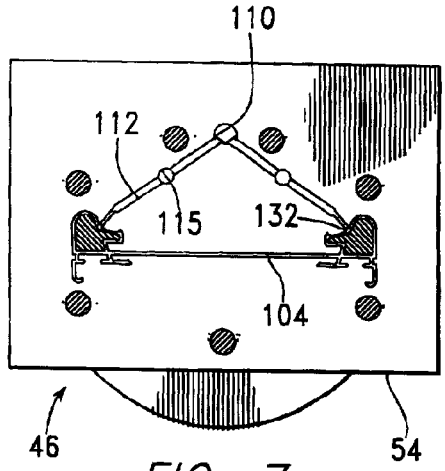
FIG. 7 is a transverse cross-sectional view of the extrusion die set of FIG. 3, taken as indicated by section lines VII—VII therein to show a die plate forming accent strip portions of the elongated member.
Figure 8:
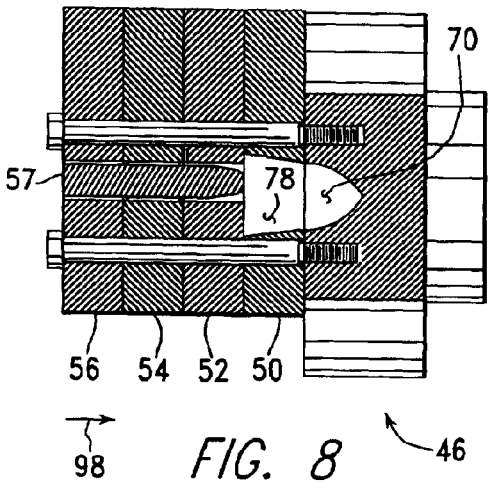
FIG. 8 is a longitudinal cross-sectional view of the extrusion die set of FIG. 3, taken as indicated by section lines VIII—VIII in FIG. 5 to show a mandrel forming interior surfaces within the elongated member.
Figure 9:
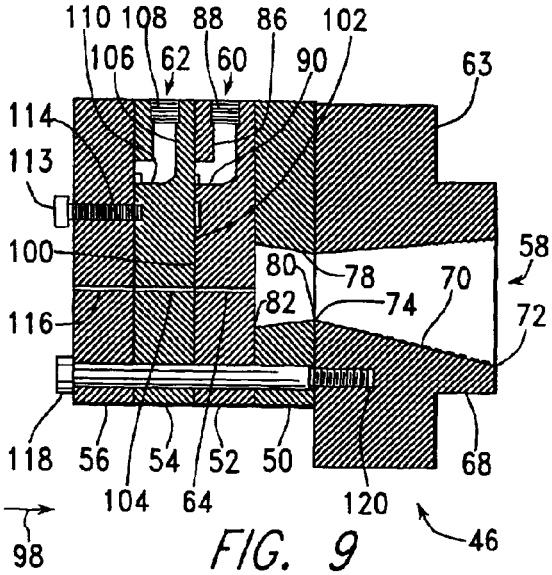
FIG. 9 is a longitudinal cross-sectional view of the extrusion die set of FIG. 3, taken as indicated by section lines IX—IX in FIG. 5 to show provisions for inserting melt streams within the die set.

FIGS. 3–9 show a die set 46 used to form, by coextrusion, the elongated extruded member subsequently used to form the central portion 12 and end portions 14 of the valance 10. FIG. 3 is a right elevation of the die set 46, which includes an adapter block 48 for attachment to an extruder (not shown), which is understood to be a device well known to those skilled in the art for providing a stream of thermoplastic melt at a temperature and pressure sufficient for passage through the opening of an extrusion die. The dies set 46 also includes a transition plate 50, a first structure forming plate 52, an accent strip forming plate 54, and a final die forming plate 56. FIGS. 4 and 5 are rear and front end views of the die set 46, respectively. FIGS. 6 and 7 are transverse cross-sectional views thereof, with FIG. 6 being taken as indicated by section lines VI—VI in FIG. 3 to show a an internal structure of the first structure forming plate 52, and with FIG. 7 being taken as indicated by section lines VII—VII in FIG. 3 to show an internal structure of the accent strip forming plate 54. FIGS. 8 and 9 are longitudinal cross-sectional views of the die set 46, with FIG. 8 being taken as indicated by section lines VIII—VIII in FIG. 5 to show a mandrel 57 forming interior surfaces within the elongated extruded member, and with FIG. 9 being taken as indicated by section lines IX—IX in FIG. 5 to show a first channel 58 through which a primary stream of thermoplastic melt is introduced into the die set 46, a second channel 60 through which a stream of thermoplastic melt is introduced to form a cap layer extending along surfaces that will be visible in the valance 10, and a third channel 62, through which a stream of thermoplastic melt is introduced to form the accent strips 30 in the valance 10.

Referring to FIGS. 4 and 9, the adapter block 48 includes a face 63 having four threaded holes 66 for attachment to the extruder (not shown), a cylindrical portion 68 for engaging the output structure of the extruder, and an opening 70 forming a portion of the channel 58 receiving a primary flow of thermoplastic melt from the extruder. The opening 70 extends from a round input aperture 72 to a generally rectangular output aperture 74 at the front surface 76 of the adapter block 48. The transition plate 50 includes an opening 78 extending as a portion of the channel 58 between an input aperture 80, coextensive with the output aperture 74 of the adapter block 48, and an output aperture 82, which is somewhat larger than the input aperture 80.

Referring to FIGS. 6 and 9, the first structure forming plate 52 includes an opening 84 through which the primary flow of thermoplastic melt from channel 58 is forced to form the core of the elongated extruded member. This opening 84 has the general shape of the elongated extruded member, lacking the ridges to be formed as accent strips 30, and being somewhat larger than the elongated extruded member to compensate for shrinkage during cooling from an extrusion temperature.

The first structure forming plate 52 also includes the second channel 60, through which a stream of thermoplastic melt is introduced to form a cap layer extending along surfaces that will be visible in the valance 10. The second channel 60 includes an input section 86 extending downward from internal threads 88 provided for connection to a second extruder (not shown) providing a source of this thermoplastic melt, an intermediate section 90 extending forward from the input section 86 and a pair of distribution channels 92 extending outward and downward from the intermediate section 90 toward the structure forming opening 84. Each of the distribution channels 92 is bifurcated to form a pair of channels 94 extending along sides of a distribution surface 96, which is offset in the direction of arrow 98 from the front surface 100, which is held against an adjacent rear surface 102 of the second structure forming plate 54. In this way, a narrow space is formed, allowing the thermoplastic melt from the second channel 60 to flow to the surfaces of the structure being extruded opposite the direction of arrow 98 through the structure forming opening 64 that are exposed to the distribution surface 96. These surfaces of the structure include the surfaces that will be visible within the valance 10 to be constructed using the structure.

Referring to FIGS. 7 and 9, the second structure forming pate 54 includes a opening 104 through which the flow of thermoplastic material from the opening 84 of the first structure forming plate 52 and the cap of thermoplastic material formed over a portion of this structure from the flow of thermoplastic melt driven through channel 60. The opening within the opening 104 adjacent the areas of the thermoplastic material where this cap is formed may be enlarged to provide for the thickness of this cap. Like the opening 84, the opening 104 does not include provisions for the ridge shape of the accent strips 30.

The second structure forming plate 54 also includes the third channel 62, through which a stream of thermoplastic melt is introduced to form the accent strips 30. The third channel 62 includes an input section 106 extending downward from internal threads 108 provided for connection provided to a third extruder (not shown) providing a source of this thermoplastic melt, an intermediate section 110 extending forward from the input section 106 and a pair of distribution channels 112 extending outward and downward from the intermediate section 110 toward the locations where the accent strips 30 are to be formed along the melt structure being driven through the opening 104.

Referring additionally to FIG. 5, a pair of screws 113, engagin threaded holes 114 within the final die forming plate 56 and extending into cavities 115 within the second structure forming plate 54, are turned to balance the flow of thermoplastic melt within the two distribution channels 112. Each of the screws 113 forms a variable restriction within the corresponding distribution channel 112, with the screws 113 being separately adjustable to balance the flow of thermoplastic melt forming the two accent strips 30. The final die forming plate 56 additionally includes an opening 116, which is similar in shape to the opening 104 within the second structure forming plate 54 except that recessed areas 117 are included in the opening 114 to form the ridge-shaped structure of the accent strips 30. The various structures within the die set 46 are held together by a number of bolts 118 extending through holes in the plates, 50, 52, 54, and 56 to engage threaded holes 120 within the adapter block 48.

Figure 10:
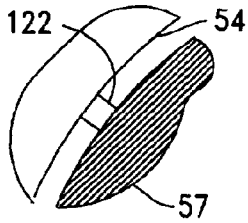
FIG. 10 is a fragmentary cross-sectional view of the extrusion die set of FIG. 3, taken as indicated by section lines VII—VII therein to show a connection bridge holding a mandrel within the die set in place.

FIG. 10 is a fragmentary cross-sectional view taken as indicated by section lines VII—VII in FIG. 3 to show a connection bridge 122 holding the mandrel 57 in place within the second structure forming plate 54. Several such connection bridges 122 are spaced around the mandrel 57. Referring additionally to FIG. 8, a pair of mandrels 57, while being supported by bridges 122 within the second structure forming plate 54, extends additionally within the first structure forming plate 60 and the final die forming plate 56. Thermoplastic material flowing opposite the direction of arrow 98 through the opening between the mandrel 57 and adjacent surfaces of the opening 104 is separated by the bridges 122 to be rejoined after flowing past the bridges 122.

Figure 11:
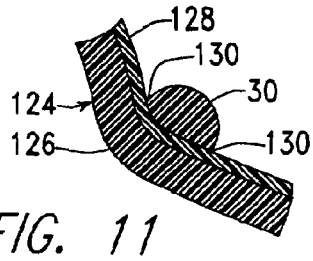
FIG. 11 is a fragmentary transverse cross-sectional view of an elongated member formed within the die set of FIG. 3, showing an accent strip formed with a minimum acceptable flow of thermoplastic material into the accent strip.
Figure 12:
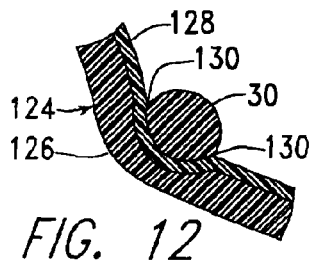
FIG. 12 is a cross-sectional view similar to FIG. 11, except that the accent strip is formed with a substantially higher flow of thermoplastic material into the accent strip.

FIGS. 11 and 12 are fragmentary transverse cross-sectional views of the elongated extruded member 124 formed within the die set 46, showing allowable variations in the formation of the accent strips 30. The elongated extruded member 124 includes a core layer 126 formed of thermoplastic material driven into the die set 46 through the first channel 58, a cap layer 128 formed of thermoplastic material driven through the second channel 60, and the accent strip 30, formed of thermoplastic material driven through the third channel 62. For example, the core layer 126, the cap layer 128, and the accent strip 30 are each composed of a polyvinyl chloride resin, with the materials forming the cap layer 128 and the accent strip 30 including additives to achieve a particular, repeatable color of the material and to protect the material from damage or discoloration by ultraviolet light. The cap layer 128 and the accent strip 30 have different coloration additives to produce different colors. The use of the cap layer 128 in this way allows the use of a less expensive thermoplastic material, not requiring stabilization for exposure to ultraviolet light, and not requiring accurate color control, for the core layer 126 forming a substantial part of the elongated extruded member 124.

As described in the prior art, previous attempts to produce coextruded strips of materials having different colors have been troubled by difficulties in controlling the appearance of the edges of the strips. These difficulties result from the mixing of materials at the edges of the strip, so that the appearance of these edges is blurred, and from variations in the width of the strips or in the straightness of their edges due to changes in the rate at which material forming the edges flows through the extrusion die.

In accordance with the present invention, the visible effects of such difficulties are alleviated by the shape of the accent strip 30 being formed as an outward-extending ridge, with corners 130 being formed in the exterior shape of the elongated extruded member 124 at the location of the external color change occurring between the accent strip 30 and the adjacent cap layer 128. Referring again to FIGS. 5 and 7, these corners 130 are formed by corners 132 within the second structure forming plate 54 adjacent the ends of distribution channels 112 and by similar corners at the edges of recessed areas 117 within the opening 116 of the final die forming plate 56.

In the example of FIG. 11, thermoplastic material has been flowed to form the accent strip 30 at a rate sufficient to form the strip and to close a gap between the accent strip 30 and the underlying cap layer 128, resulting in a satisfactory version of the accent strip 30. In the example of FIG. 12, thermoplastic material has been flowed to form the accent strip 30 at a substantially greater rate, causing the accent strip to bulge into the underlying thermoplastic material 128, which is still soft when the accent strip 30 is formed. Since the external appearance of the elongated member 124 is the same as shown in FIGS. 11 and 12, these FIGS. both show acceptable versions of the elongated member 124. The additional material forming the accent strip 30 in FIG. 12 extends into a bulge that is formed opposing the pressure of the material forming the cap layer 128 and the core layer 126, since it is more difficult for this material forming the accent strip 30 to flow around the corners 130, while additionally opposing the pressure of the other material. Furthermore, a mixing of the materials at the interface between the accent strip 30 and the underlying cap strip 128 does not blur the external appearance of the change in colors.

While the process of forming an accent strip as an outward-extending ridge has been explained as a part of a process for manufacturing a valance assembly having two such strips, it is understood that this process can be used, within the scope of the invention, to produce other types of elongated members with one or more accent strips of this type.

While the invention has been described with some degree of particularity, it is understood that this description has been given only by way of example, and that many changes can be made without departing from the spirit and scope of the invention.

What is claimed is:

1. A method for fabricating a valance, wherein said method comprises:

extruding an elongated member composed of thermoplastic resin through a die set an opening having a first opening portion causing thermoplastic melt extruded therethrough to form an upper curved shape, a second opening portion causing thermoplastic melt extruded therethrough to form a web shape extending from said upper curved shape, and a third opening portion causing thermoplastic melt extruded therethrough to form a lower curved shape extending from said web shape, wherein said first opening portion and said third opening portion each include a mandrel.

a melt of said thermoplastic resin flows around each said mandrel to from a hollow, closed structure of said thermoplastic resin as a portion of said elongated member;

said thermoplastic resin includes a first thermoplastic resin having a first color and a second thermoplastic resin having a second color, contrasting with said first color, in said die set includes first an second structure forming plates, said first thermoplastic resin is extruded through said first structure forming plate, after extrusion through said first structure forming plate, said first thermoplastic resin is coextruded through said second structure forming plate with said second thermoplastic resin, said second structure forming plate includes a first groove extending as part of said first opening portion between corners in said first opening portion, and said second thermoplastic material is forced into said first groove to form a first outward-extending ridge;

sawing said elongated member to form mitered surface extending at a both ends of a central elongated portion of said valance and to form a pair of end portions of said valance, wherein each said end portion includes a mitered end and an end extending perpendicular to a length of said end portion; and attaching said end portions to extend in a common direction from each end of said central elongated portion.

2. The method of claim 1, wherein said second structure forming plate additionally includes a second groove extending as part of said second opening portion between corners in said second opening portion, and said second thermoplastic material is additionally forced into said second groove to form a second outer-extending ridge.

3. The method of claim 2, wherein a flow of said second thermoplastic resin is divided between a first channel extending to said first groove and a second channel extending to said second groove, and said first and second channels each contain a variable restriction for balancing flows of said second thermoplastic material to said first and second grooves.

4. A method for fabricating a valance, wherein said method comprises:

extruding an elongated member composed of thermoplastic resin through a die set including an opening having a first opening portion causing thermoplastic melt extruded therethrough to form an upper curved shape, a second opening portion causing thermoplastic melt extruded therethrough to form a web shape extending from said upper curved shape, and a third opening portion causing thermoplastic melt extruded therethrough to form a lower curved shape extending from said web shape, wherein said first opening portion and said third opening portion each include a mandrel, a melt of said thermoplastic resin flows around each said mandrel to from a hollow, closed structure of said thermoplastic resin as a portion of said elongated member;

said thermoplastic resin includes a first thermoplastic resin, a second thermoplastic resin having a first color and a third thermoplastic resin having a second color, contrasting with said first color, said die set includes first, second, and third structure forming plates, said first thermoplastic resin is extruded through said first structure forming plate, after extrusion through said first structure forming plate, said first thermoplastic resin is coextruded through said second structure forming plate with said second thermoplastic resin, said second thermoplastic resin forms a cap around a peripheral portion of said elongated member within said first and third opening portions, after extrusion and coextrusion through said first and second structure forming plates, said first and second thermoplastic resins are coextruded through said third structure forming plate with said third thermoplastic resin, said third structure forming plate includes a first groove extending as part of said first opening portion between corners in said first opening portion, and said third thermoplastic material is forced into said first groove to form a first outward-extending ridge;

sawing said elongated member to form mitered surfaces extending at both ends of a central elongated portion of said valance and to form a pair of end portions of said valance, wherein each said end portion includes a mitered end and an end extending perpendicular to a length of said end portion; and attaching said end portions to extend in a common direction from each end of said central elongated portion.

5. The method of claim 4, wherein said third structure forming plate additionally includes a second groove extending as part of said second opening portion between corners in said second opening portion, and said third thermoplastic material is additionally forced into said second groove to form a second outward-extending ridge.

6. The method of claim 5, wherein a flow of said third thermoplastic resin is divided between a first channel extending to said first groove and a second channel extending to said second groove, and said first and second channels each contain a variable restriction for balancing flows of said third thermoplastic material to said first and second grooves.

7. A method for fabricating a valance, wherein said method comprises:

extruding an elongated member composed of thermoplastic resin through a die set including an opening having a first opening portion causing thermoplastic melt extruded therethrough to form an upper curved shape, a second opening portion causing thermoplastic melt extruded therethrough to form a web shape extending from said upper curved shape, and a third opening portion causing thermoplastic melt extruded therethrough to form a lower curved shape extending from said web shape, wherein said thermoplastic resin includes a first thermoplastic resin having a first color and a second thermoplastic resin having a second color, contrasting with said first color, said die set includes first and second structure forming plates, said first thermoplastic resin is extruded through said first structure forming plate, after extrusion through said first structure forming plate, said first thermoplastic resin is coextruded through said second structure forming plate with said second thermoplastic resin, said second structure forming plate includes a first groove extending as part of said first opening portion between corners in said first opening portion, and said second thermoplastic material is forced into said first groove to form a first outward-extending ridge;

sawing said elongated member to form mitered surfaces extending at both ends of a central elongated portion of said valance and to form a pair of end portions of said valance, wherein each said end portion includes a mitered end and an end extending perpendicular to a length of said end portion; and attaching said end portions to extend in a common direction from each end of said central elongated portion.

8. The method of claim 7, wherein said second structure forming plate additionally includes second groove extending as part of said second opening portion between comers in said second opening portion, and said second thermoplastic material is additionally forced into said second groove to form a second outer-extending ridge.

9. The method of claim 8, wherein a flow of said second thermoplastic resin is divided between a first channel extending to said first groove and a second channel extending to said second groove, and said first and second channels each contain a variable restriction for balancing flows of said second thermoplastic material to said first and second grooves.

10. A method for fabricating a valance, wherein said method comprises:

extruding an elongated member composed of thermoplastic resin through a die set including an opening having a first opening portion causing thermoplastic melt extruded therethrough to form an upper curved shape, a second opening portion causing thermoplastic melt extruded therethrough to form a web shape extending from said upper curved shape, and a third opening portion causing thermoplastic melt extruded therethrough to form a lower curved shape extending from said web shape, wherein said first opening portion and said third opening portion each include a mandrel, a melt of said thermoplastic resin flows around each said mandrel to from a hollow, closed structure of said thermoplastic resin as a portion of said elongated member;

said thermoplastic resin includes a first thermoplastic resin, a second thermoplastic resin having a first color and a third thermoplastic resin having a second color, contrasting with said first color, said die set includes first, second, and third structure forming plates, said first thermoplastic resin is extruded through said first structure forming plate, after extrusion through said first structure forming plate, said first thermoplastic resin is coextruded with through said second structure forming plate with said second thermoplastic resin, said second thermoplastic resin forms a cap around a peripheral portion of said elongated member within said first and third opening portions, after extrusion and coextrusion through said first and second structure forming plates, said first and second thermoplastic resins are coextruded through said third structure forming plate with said third thermoplastic resin, said third structure forming plate includes a first groove extending as part of said first opening portion between corners in said first opening portion, and said third thermoplastic material is forced into said first groove to form a first outward-extending ridge;

sawing said elongated member to form mitered surfaces extending at both ends of a central elongated portion of said valance and to form a pair of end portions of said valance, wherein each said end portion includes a mitered end and an end extending perpendicular to a length of said end portion; and attaching said end portions to extend in a common direction from each end of said central elongated portion.

11. The method of claim 10, wherein said third structure forming plate additionally includes second groove extending as part of said second opening portion between corners in said second opening portion, and said third thermoplastic material is additionally forced into said second groove to form a second outward-extending ridge.

12. The method of claim 11, wherein a flow of said third thermoplastic resin is divided between a first channel extending to said first groove and a second channel extending to said second groove, and said first and second channels each contain a variable restriction for balancing flows of said third thermoplastic material to said first and second grooves.

* * * * *